United States Patent [19]

Stromquist

[11] Patent Number: 4,760,621

[45] Date of Patent: Aug. 2, 1988

[54] COMBINATION DOORSTOP, HOLDOPEN AND SHOCK ABSORBER

[75] Inventor: Michael E. Stromquist, Encino, Calif.

[73] Assignee: Anthony's Manufacturing Co., Inc., San Fernando, Calif.

[21] Appl. No.: 867,525

[22] Filed: May 27, 1986

[51] Int. Cl.[4] ..... E05C 17/12; B65D 43/24

[52] U.S. Cl. ..... 16/85; 16/DIG. 10; 16/DIG. 77; 220/335

[58] Field of Search ..... 16/85, 82, 63, 65, DIG. 10, 16/DIG. 17, 49, 51, 66; 220/335

[56] References Cited

U.S. PATENT DOCUMENTS

| | | | |
|---|---|---|---|
| 313,457 | 3/1885 | Tuerk . | |
| 644,203 | 2/1900 | Hoffman . | |
| 2,779,050 | 1/1957 | Semar . | |
| 2,893,050 | 7/1959 | Hollansworth . | |
| 3,262,140 | 7/1966 | Gorton et al. . | |
| 3,710,417 | 1/1973 | Berman et al. . | |
| 4,048,695 | 9/1977 | Juilfs | 16/85 |
| 4,423,535 | 1/1984 | Ojima | 16/85 |
| 4,545,322 | 10/1985 | Yang | 16/85 |
| 4,629,167 | 12/1986 | Kimura | 16/66 |

FOREIGN PATENT DOCUMENTS

| | | | |
|---|---|---|---|
| 1584227 | 8/1970 | Fed. Rep. of Germany | 16/85 |

*Primary Examiner*—Nicholas P. Godici
*Assistant Examiner*—Edward A. Brown
*Attorney, Agent, or Firm*—Poms, Smith, Lande & Rose

[57] ABSTRACT

The device includes a coiled extension spring, one end containing a hook for pivotal attachment either to the door or door frame, the other end being open to receive an elongated, tubular guide, one end of which threads into the open end of the spring. The other end of the guide is closed and contains a coaxial aperture through which slides an elongated rod having one end adapted for pivotal attachment to the other of the door or door frame and a piston attached to its second end which is slidably-retained within the guide to position the rod during relative coaxial sliding of the rod and guide, and to stop the rod against further protractive movement when the piston abuts the closed end of the guide. Camming surfaces located radially on the piston cooperate with opposing follower means in the guide, of which two embodiments are disclosed, to clamp the piston in the most extensive position of the rod, which clamping action can be overcome by a retractive force of the rod of a predetermined amount. When in the fully-protracted position, the device is capable of absorbing large amounts of shock, such as would be caused by collisions by heavy objects against the door.

21 Claims, 4 Drawing Sheets

Fig. 1.
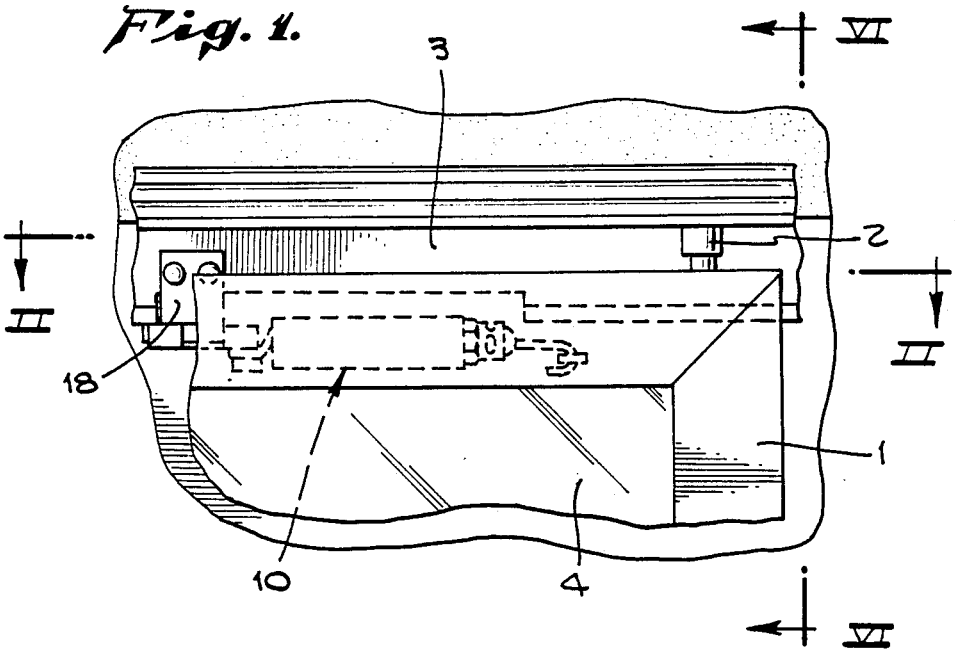
Fig. 2.
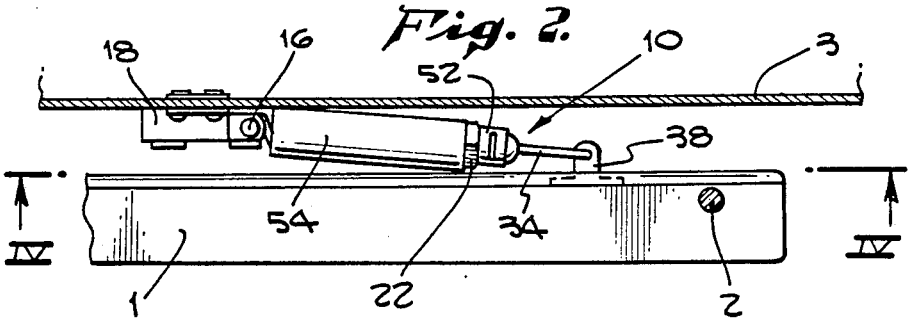
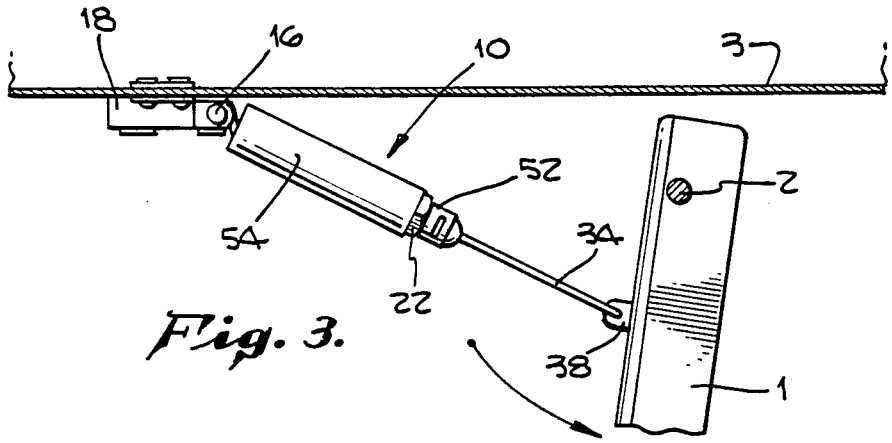
Fig. 3.

Fig. 9.
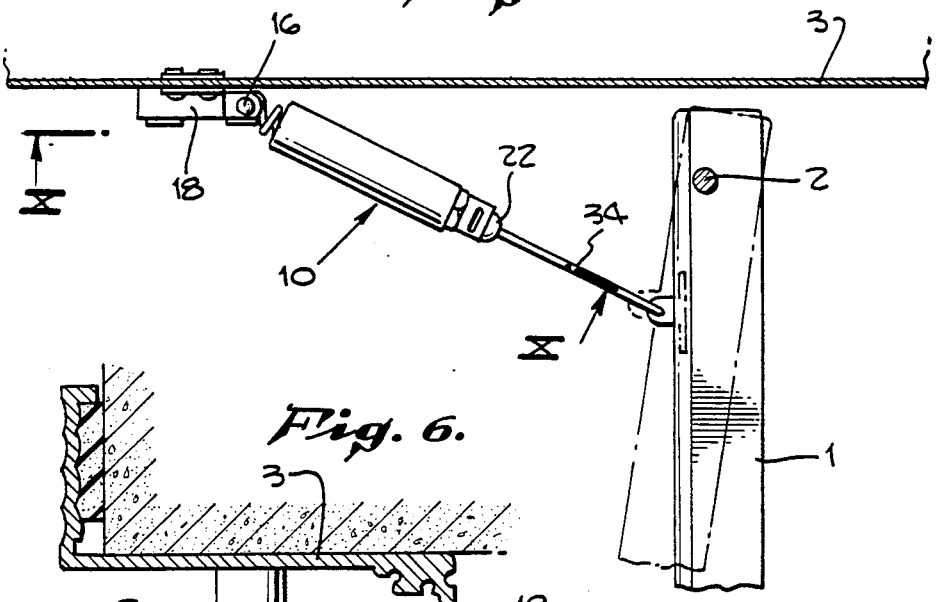
Fig. 6.
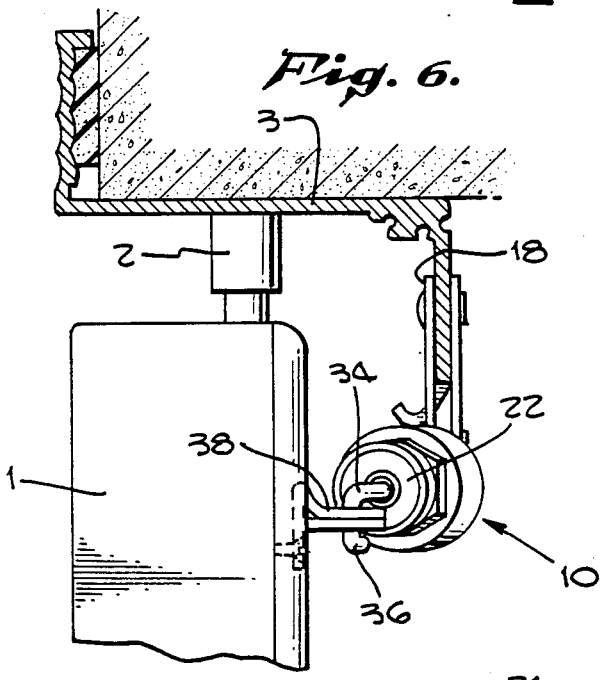
Fig. 8.
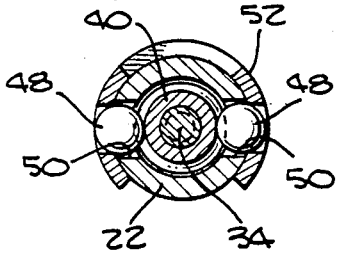
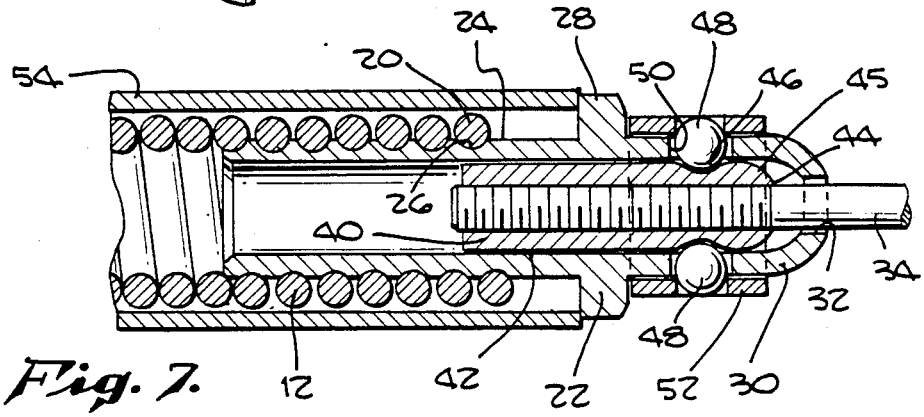
Fig. 7.

XIII
XIV
10
12
14
16
18
22
28
34
36
38
40
48
52
53
54
101
103
112
114
116
118
122
128
134
136
138
140
148
150
154

COMBINATION DOORSTOP, HOLDOPEN AND SHOCK ABSORBER

BACKGROUND OF THE INVENTION

1. Field of the Invention

This invention pertains, in general, to door opening, closing, and latching hardware, and in particular, to a combination doorstop, holdopen, and shock absorber.

2. Description of the Prior Art

Devices for stopping the opening movement of a door hinged to a doorframe and/or for holding doors open at a predetermined position have application in many fields. For example, the automotive industry makes widespread use of such devices, as evidenced by U.S. Pat. No. 3,710,417 to Berman, et al, or that to Hollansworth in U.S. Pat. No. 2,893,050.

A similar device is illustrated in the Doorcheck and Holdopen of Semar in U.S. Pat. No. 2,779,050.

Similarly, the cabinet-making art frequently relies upon hinges which incorporate some means for stopping and/or holding a cabinet door at a predetermined open position. Examples of this art are to be found in, e.g., the disclosures of Tuerk in U.S. Pat. No. 313,457, Hoffman in U.S. Pat. No. 644,203, or to Gorgon, et al, U.S. Pat. No. 3,262,149.

One field to which this invention is particularly applicable is that of hinged appliance doors, e.g. refrigerator doors, and more particularly, to refrigerated display units such as are to be found in supermarkets and self-service stores. In this latter field, it is desirable to have a large, typically double-glazed door stopped and retained at an open position of about 90 degrees so that customers and/or stocking clerks can access the refrigerated contents of the cases conveniently for selection of purchases or for stocking. These doors typically are hinged separately and may incorporate an automatic return mechanism separately or within the hinge mechanism itself. Thus, it is desirable to have a mechanism which will retain the door in the opened position by a force of a predetermined amount at least equal to that exerted by the closing mechanism, which holdopen force can be easily overcome by the application of a greater manual, external closing force of a predetermined amount exerted on the door. Additionally, it is desirable that the doorstop and holdopen be capable of absorbing shock forces suddenly applied to the door, such as may be occasioned during the collision with the open door of passing vehicles, such as grocery carts, forklifts, etc., to avoid damage.

The object of the present invention is, therefore, the provision of a combination doorstop, holdopen, and shock absorber for a door hingably-attached to a door frame. It is a further object of the present invention to provide such a device that is simple and inexpensive to fabricate, but which is smooth and reliable in operation and able to withstand the rigors of hard use.

SUMMARY OF THE INVENTION

These objects are preferably accomplished in a device comprising a tubular guide having means at one end for attaching a guide for pivotal movement to either of the door or its frame and the closed end having an aperture through which an elongated member, having means at one end for attaching the member for pivotal movement to the other of the door or its frame, and an enlarged portion, or piston, at the other end which is slidably-retained within the guide for aligning the rod axially during protractive and retractive sliding movement relative to the guide and for stopping the rod against further protractive movement when the piston is in abutment with the closed end of the guide, the enlarged end, or piston, having camming means on its external surface for cooperating with a pair of radially-opposing follower means contained within the guide to clamp the piston, either radially between the follower means or axially between the follower means and the closed end of the guide, at the most extensive position of the rod, to hold the door in the open position. In a narrower embodiment, the guide may attach to either the door or the frame through an extension spring for absorbing larger shocks imposed on the door when held in the open position.

A more complete understanding of the device and its objects and advantages will become evident to those skilled in the art from a consideration of the following detailed description of the preferred embodiments, when read in conjunction with the appended drawings, a brief description of which now follows.

BRIEF DESCRIPTION OF THE DRAWINGS

FIG. 1 is a plan view of an appliance door hingably-attached to a door frame with a first preferred embodiment of the device of the instant invention shown in dotted outline and in which views II—II and VI—VI are taken;

FIG. 2 is a top view of the device, as revealed by the view II—II taken in FIG. 1;

FIG. 3 is a top view, similar to FIG. 2, showing the operation of the device when the door is swung open in the direction of the arrow shown;

FIG. 6 is an end view of the device as revealed by the sectional view VI—VI taken in FIG. 1;

FIG. 7 is a detailed cross-sectional view through the side of the device, as revealed by the view VII—VII taken in FIG. 5;

FIG. 8 is a detailed cross-sectional view through the end of the device as revealed by the view VIII—VIII taken in FIG. 5;

FIG. 9 is a top view of the device illustrating its shock absorbing function;

DETAILED DESCRIPTION OF THE PREFERRED EMBODIMENTS

Figure 4:
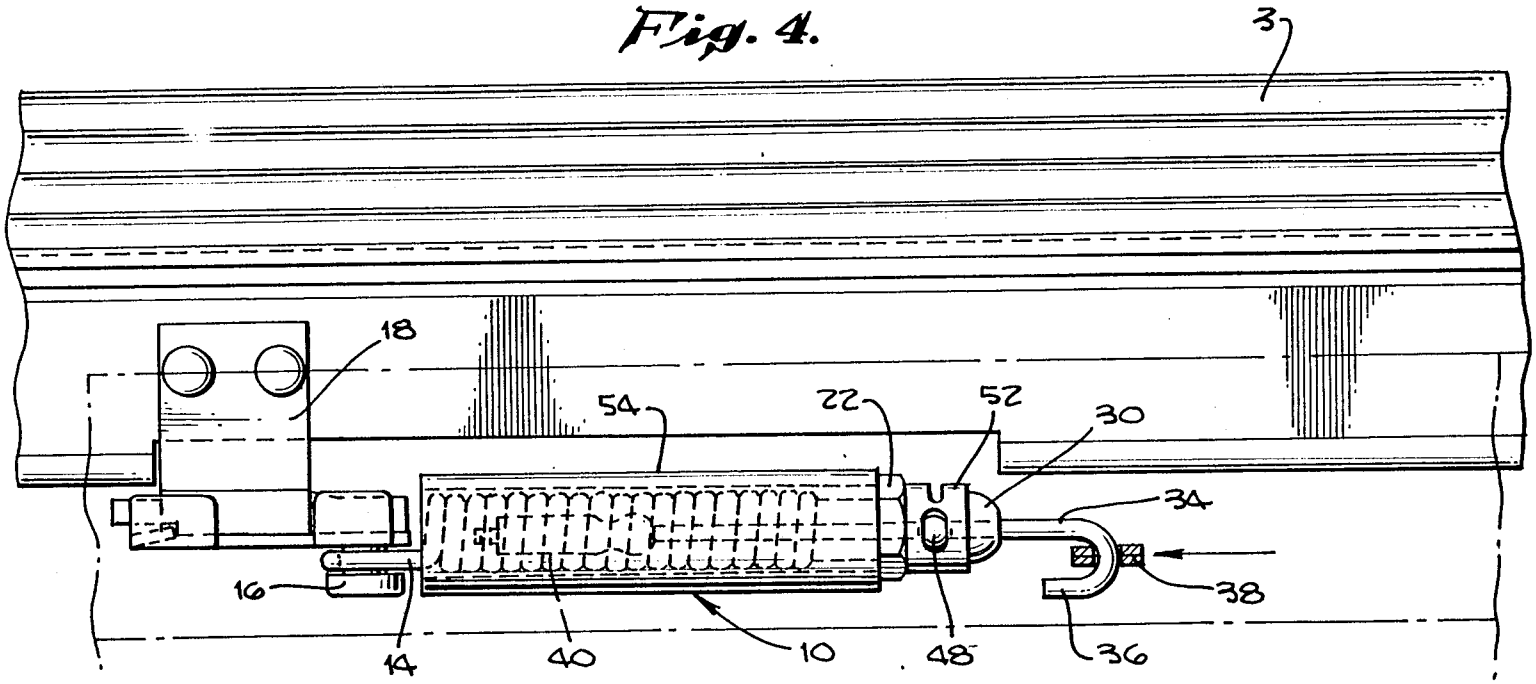
FIG. 4 is a front view of the device, as revealed by the sectional view IV—IV taken in FIG. 2, with the device in the fully-retracted position.
Figure 5:
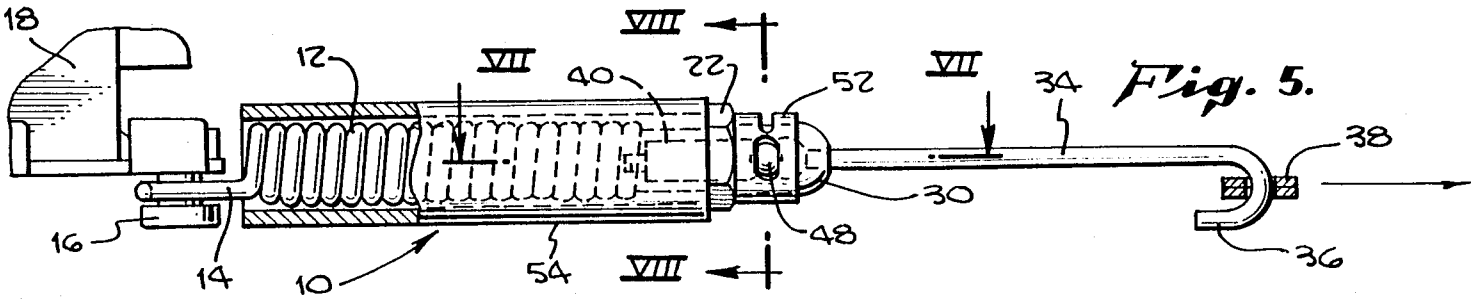
FIG. 5 is similar to FIG. 4 and illustrates the device in the fully-protracted, holdopen position.

An exemplary first preferred embodiment of the combined doorstop, holdopen and shock absorber 10 of the present invention is illustrated in FIGS. 1–11.

In the exemplary embodiment illustrated, device 10 is shown in association with an appliance door 1 hingably-attached by means of a conventional hinge 2 to a door frame 3 for right-hand opening, such as may be found in a commercial grade, refrigerated display case, in which case door 1 may be provided with insulated double-glazing 4 for product visibility. (See FIGS. 1–3.)

In the exemplary embodiment illustrated, device 10 comprises a tightly-wound, coil extension spring 12 having a single coil at one end formed into the shape of a hook 14 for pivotal attachment through pin 16 connected to bracket 18 mounted to door frame 3. The other end 20 of spring 12 is left open, and has threaded into it one end of a cylindrical, tubular guide 22.

Tubular guide 22 includes an outer circumference 24 containing a single thread 26 which is conjugate with the coils of spring 12 such that guide 22 can be threaded into open end 20 of spring 12 for firmly attaching of guide 22 thereinto. (See FIG. 7) Additionally, guide 22 may include a tool-gripping feature 28, such as a hex surface, usable for threading guide 22 into spring 12. In this connection, it should be observed that if extension spring 12 is tightly coiled and made of a suitably-stiff, heat-treated alloy steel, it may be desirable to provide coil spring 12 with a slight opening taper at open end 20 to permit guide 22 to be more easily threaded thereinto.

Opposite spring 12, guide 22 further includes a closed end 30 containing a cylindrical aperture 32 extending coaxially therethrough. In the preferred exemplary embodiment illustrated, it is anticipated that guide 22 will be machined from a bar or rod of mild steel such that the rounded aspect of closed end 30, as well as cylindrical aperture 32, will be formed as a part of the machining process. On the other hand, skilled practitioners will recognize that closed end 30 and aperture 32 of guide 22 may alternatively be fabricated in a rolling process.

Extending through aperture 32 is an elongated rod 34 having one end formed into a hook 36 for pivotal engagement with a bearing bracket 38 mounted to the backside of door 1 inboard of hinge 2. Skilled practitioners will recognize that, through slight modification of frame-attaching hook 14 and door-attaching hook 36, the mounting position of device 10 can easily be reversed end-for-end.

The end of rod 34 opposite attachment hook 36 is freely retained within guide 22 for relative sliding movement therein, and has mounted at this end a cylindrical sliding piston 40 whose outer circumference 42 is sized for loose and smooth sliding within the internal diameter of guide 22 to align rod 34 coaxially with guide 22 during relative sliding movement of the two parts. Piston 40 includes an end 44 proximate to rod 34 having an area greater than aperture 32 which, when rod 34 is fully-extended, abuts closed end 30 of guide 22, to prevent further protractive movement of rod 34 relative to guide 22, thereby serving as a stop. Piston 40 may be formed integrally of rod 34, but for ease of fabrication and assembly, is preferably threaded internally to receive engaging threads formed on the end of rod 34.

Piston 40 additionally includes at proximate end 44 a convex, spherically-shaped camming surface 45, and tangentially distal thereto, a concave, hemitoroidal camming surface 46. (See FIGS. 7 and 8.) Camming surfaces 45 and 46 are configured to engage and cooperate with follower means disposed within tubular guide 22. In the exemplary first embodiment illustrated, these follower means comprise at least two radially-opposed ball bearings 48 which are retained in guide 22 within a pair of apertures 50 evenly-spaced about the circumference of guide 22. Ball bearings 48 are retained within guide 22 by means of a split sleeve spring 52 (see FIG. 11). Sleeve spring 52 contains a pair of slotted apertures 53 which engage ball bearings 48 radially and bias them radially inward toward piston 40.

To complete device 10, a cylindrical tube 54 may be fitted around the exterior of extension spring 12 to lend a smooth, finished appearance and to keep dirt out of the device.

The operation of device 10 is best illustrated in FIGS. 2–5 and 9. In its fully-retracted position, device 10 nests in the space between the rear of door 1 and the front of frame 3, as illustrated in FIGS. 1 and 2, and assumes the configuration illustrated in FIG. 4, with piston 40 located well within the hollow core of extension spring 12.

As door 1 is swung outwardly in the direction of the arrow illustrated in FIG. 3, rod 34 is smoothly protracted from within spring 12 and guide 22, while the two ends of device 10 pivot relative to their points of attachment on door 1 and frame 3.

As rod 34 approaches its most fully-protracted position relative to guide 22, spherically-shaped camming surface 45 on piston 40 engages ball bearings 48, and upon further protractive movement, forces them radially outward, which serves to retard further protractive movement of rod 34. Still further protractive movement of rod 34 causes the followers 48 to ride over center to engage the convex, hemitoroidal camming surfaces 46, which engagement clamps piston 40 between followers 48 to resist either further retractive or protractive movement, thus serving to hold door 1 in the open position. Upon still yet further protractive movement of rod 34, proximate end 44 of piston 40 will abut closed end 30 of guide 22 and act as a stop.

Thus, it may be seen that the followers, consisting of the ball bearings 48 in the exemplary first preferred embodiment illustrated, serve a plurality of useful functions. Being evenly-distributed and acting radially inward, ball bearings 48 are retained in place by rod 34 in its more retractive positions and serve, along with piston 40, to center rod 34 during relative protractive sliding thereof with a smooth, rolling action. In the more protractive positions of rod 34, ball bearings 48 interact with the camming surfaces 45 and 46 on piston 40 to retard both protractive or retractive movement and in the almost-fully-protracted position, to hold door 1 open.

Figures 10, 11, 12, 13, 14:
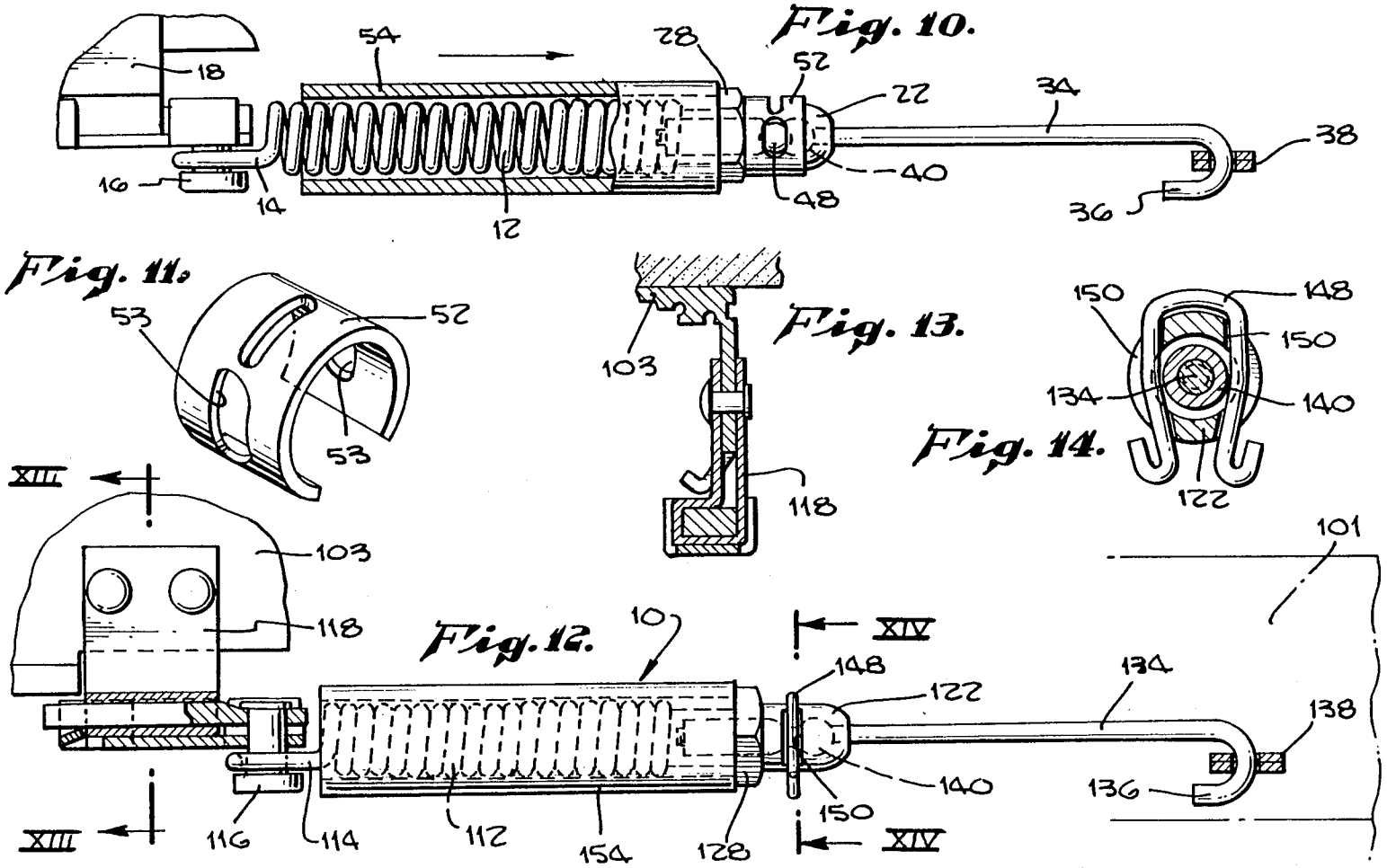
FIG. 10 is a partial sectional view through the side of the device, as revealed by the section X—X taken in FIG. 9, illustrating the expansion of a coil spring to absorb a shock force applied to the device in the direction of the arrow shown.
FIG. 11 is a semi-cylindrical sleeve spring and retainer clip of the first embodiment.
FIG. 12 is a side view of a second preferred embodiment of the device of the present invention, shown in its fully-protracted position.
FIG. 13 is a detailed view through the support bracket of the second preferred embodiment, as revealed by the section XIII—XIII taken in FIG. 12.
FIG. 14 is a detailed cross-sectional view through the follower means of the second preferred embodiment, as revealed by the section XIV—XIV taken in FIG. 12.

In the exemplary embodiment illustrated (see FIG. 9), door 1 is held by device 10 in an open position of about 82.5 degrees relative to door frame 3, as illustrated by the phantom lines in FIG. 9. In this position, door 1 is vulnerable to shocks occasioned by collision with door 1 of passing objects, such as shopping carts or the like. During such collisions, door 1 may be permitted to open as much as 90 degrees or more, as illustrated in FIG. 9, by the operation of spring 12. This operation is best illustrated in FIG. 10, in which an opening shock force upon rod 34 acting in the direction of the arrow shown is absorbed by the extension of spring 12 in the direction of the arrow and the spreading of the coils, as illustrated. Additionally, it should be noted that spring 12 also resists and absorbs any components of turning moments acting on device 12 due to any coaxial misalignment of rod 34 within guide 22.

It will be observed that, if coil spring 12 were omitted from device 10 and guide 22 were provided with means for attaching guide 22 for pivotal movement relative to one of door 1 or frame 3, the device so modified would still be capable of operating fully as a holdopen and doorstop, with an attenuated shock-absorbing function provided by the interaction of piston 40 and the followers 48. However, given the potential shock force levels typically encountered in the application illustrated, it is anticipated that device 10 preferably will incorporate extension spring 12.

An alternative, second preferred embodiment of the instant invention is illustrated in FIGS. 12–14, in which similar or identical elements are numbered identically with the first embodiment, plus 100.

The device 110 of the second preferred embodiment differs from the first preferred embodiment principally in the implementation of the follower means for cooperating with the camming surfaces 145 and 146 on piston 140. In the second preferred embodiment, the follower function is satisfied by means of a U-shaped spring clip 148 which snaps into a pair of radiallyopposed, transverse slots 150 extending through guide 122 to receive and retain clip 148 such that a portion of clip 148 extends through each slot 150 and transversely through guide 122 to cooperate with camming surfaces 145 and 146 on piston 140. While the spring clip 148 of the second preferred embodiment incorporates fewer parts than the first preferred embodiment, its cooperation with piston 140 results in a relative sliding movement, as opposed to the rolling movement afforded between the ball bearings 48 and the piston 40 of the first embodiment, and accordingly, entails more friction, more wear, and a slightly rougher operation.

By now, skilled practitioners will recognize that other modifications of the instant invention are possible in terms of materials, methods of manufacture, and assembly, depending upon the particular application at hand. Accordingly, the embodiments illustrated and discussed in the accompanying specification and drawings should be taken as exemplary in nature, and the scope and spirit of the instant invention should be limited only by the following claims.

What is claimed is:

1. A doorstop and holdopen for a door hingably-attached to a door frame, comprising:

a tubular guide having means at one end for attaching said guide for pivotal movement to one of said door or said frame, and a closed second end containing an aperture therethrough;

an elongated member having a first end and a second end said first end having means thereat for attaching said member for pivotal movement to the other of said door or said frame, said member extending through said aperture into said guide and having an enlarged portion at said second end slidably-retained therein for aligning said member axially during protractive and retractive sliding movement relative to said guide and for stopping said member against further protractive movement when said portion is in abutment with said closed end of said guide, said enlarged portion having camming means thereon for exerting radial forces with axial movement of said member; and follower means unconnected to both said enlarged portion of said elongated member an said guide mounted in said second end of said guide for cooperating with said camming means on said enlarged portion of said member to exert an axial force against retractive displacement of said member when said member is in a fully-protracted position and hold said member in said position, and for releasing said force upon a protractive displacement of said member with a predetermined axial force in the opposite direction.

2. The apparatus of claim 1, wherein said second end of said member further comprises:

a piston attached to said second end, said piston having an end proximate to said member with an area greater than said aperture to abut said guide's closed end when said member is in said fully-protracted position, an end distal of said member having at least two radially-opposite camming surfaces thereon inclined to said member's axis and disposed to operate said follower means upon retractive movement of said piston, and at least two radially-opposite camming surfaces between said ends inclined to said member's axis and disposed to operate said follower means upon protractive movement of said piston.

3. The apparatus of claim 2, wherein said follower means further comprise:

at least two followers in said guide located away from said closed end and retained therein for radial movement in evenly-spaced, inwardly-biased radial opposition to said member, each said follower having at least two oppositely-facing following surfaces thereon inclined to the normal of said member's axis and disposed to cooperate with said camming surfaces on said piston to displace said followers radially-outward with retractive or protractive movement of said piston; and means for biasing said followers toward said elongated member.

4. The apparatus of claim 3, wherein said piston further comprises:

an extension on said distal end of said piston, said extension having at least two concave depressions therein, each said depression being radially opposed to one of said followers and conjugate therewith to receive said followers and clamp said piston centered therebetween at about said member's most extensive position.

5. The apparatus of claim 3, wherein each said follower further comprises:

a ball bearing;

means for retaining said ball bearing in said guide for radial movement therein in radial opposition to said member; and means for biasing said ball bearing toward said member.

6. The apparatus of claim 4, wherein each said follower further comprises:

a ball bearing;

means for retaining said ball bearing in said guide for radial movement therein in radial opposition to said member; and means for biasing said ball bearing toward said member.

7. The apparatus of claim 3, wherein said follower means further comprises:

a U-shaped spring clip snapped about the circumference of said guide, said guide having a pair of radially-opposed, transverse slots extending therethrough to receive and retain said clip such that a portion of said clip extends through each said slot and transversely through said guide to cooperate with said camming surfaces on said piston to displace said portions radially-outward with retractive or protractive movement of said piston.

8. The apparatus of claim 4, wherein said follower means further comprise:

a U-shaped spring clip snapped about the circumference of said guide, said guide having a pair of radially-opposed, transverse slots extending therethrough to receive and retain said clip such that a portion of said clip extends through each said slot and transversely through said guide to cooperate with said camming surfaces on said piston to displace said portions radially-outward with retractive or protractive movement of said piston.

9. A combination doorstop, holdopen, and shock absorber for a door hingably-attached to a door frame, comprising:

an extension spring having a first end with means thereat for attaching said spring for pivotal movement to one of said door or said frame, and a second end opposite thereto;

a tubular guide having one end attached to said second end of said spring and a closed second end opposite thereto containing an aperture therethrough;

an elongated member having a first end and a second end, said first end having means thereat for attaching said member for pivotal movement to the other of said door or said frame, said member extending through said aperture into said guide and having an enlarged portion at said second end slidably retained therein for aligning said member axially during protractive and retractive sliding movement relative to said guide and for stopping said member against further protractive movement when said portion is in abutment with said closed end of said guide, said enlarged portion having camming means thereon for exerting radial forces with axial movement of said member; and follower means unconnected to both said enlarged portion of said elongated member and said guide mounted in said second end of said guide for cooperating with said camming means on said enlarged portion to exert an axial force against retractive displacement of said member when said member is in a fully-protracted position and hold said member in said position, and for releasing said force upon a protractive displacement of said member with a predetermined axial force in the opposite direction.

10. The apparatus of claim 9, wherein said second end of said member further comprises:

a piston attached to said second end, said piston having an end proximate to said member with an area greater than said aperture to abut said guide's closed end when said member is in said fully-protracted position, an end distal of said member having at least two radially-opposite camming surfaces thereon inclined to said member's axis and disposed to operate said follower means upon retractive movement of said piston, and at least two radially-opposite camming surfaces between said ends inclined to said member's axis and disposed to operate said follower means with protractive movement of said piston.

11. The apparatus of claim 10, wherein said follower means further comprise:

at least two followers in said guide located away from said closed end and retained therein for radial movement in evenly-spaced, inwardly-biased radial opposition to said member, each said follower having at least two oppositely-facing following surfaces thereon inclined to the normal of said member's axis and disposed to cooperate with said camming surfaces on said piston to displace said followers radially-outward with retractive or protractive movement of said piston; and means for biasing said followers toward said elongated member.

12. The apparatus of claim 11, wherein said piston further comprises:

an extension on said distal end of said piston, said extension having at least two concave depressions therein, each said depression being radially opposed to one of said followers and conjugate therewith to receive said followers and clamp said piston centered therebetween at about said member's most extensive position.

13. The apparatus of claim 11, wherein each said follower further comprises:

a ball bearing;

means for retaining said ball bearing in said guide for radial movement therein in radial opposition to said member; and means for biasing said ball bearing toward said member.

14. The apparatus of claim 12, wherein each said follower further comprises:

a ball bearing;

means for retaining said ball bearing in said guide for radial movement therein in radial opposition to said member; and means for biasing said ball bearing toward said member.

15. The apparatus of claim 11, wherein said follower means further comprise:

a U-shaped spring clip snapped about the circumference of said guide, said guide having a pair of radially-opposed, transverse slots extending therethrough to receive and retain said clip such that a portion of said clip extends through each said slot and transversely through said guide to cooperate with said camming surfaces on said piston to displace said portions radially-outward with retractive or protractive movement of said piston.

16. The apparatus of claim 12, wherein said follower means further comprise:

a U-shaped spring clip snapped about the circumference of said guide, said guide having a pair of radially-opposed, transverse slots extending therethrough to receive and retain said clip such that a portion of said clip extends through each said slot and transversely through said guide to cooperate with said camming surfaces on said piston to displace said portions radially-outward with retractive or protractive movement of said piston.

17. A combination doorstop, holdopen, and shock absorber for a door hingably-attached to a door frame, comprising:

an extension spring having a plurality of coils open at one end and having a hooked coil at the other end for pivotal attachment to one of said door or said frame;

a cylindrical tubular guide having an open end, a closed end containing a coaxial aperture therethrough, and a single exterior thread conjugate with said coils of said spring extending from said open end for a portion of the length of said guide, said open end of said guide being threaded into said one end of said spring to a depth of said threaded portion to retain said guide therein;

a rod having a hooked portion at one end for pivotal attachment to the other of said door or said frame, said rod extending through said aperture with a sliding fit and having a second end contained within said guide;

a cylindrical piston attached coaxially to said second end of said rod within said guide, said piston having a sliding fit therein for aligning said rod coaxially with said guide during relative protractive and retractive axial movement, said piston having a convex, spherically-shaped end proximate to said rod to abut said closed end of said guide when said rod is in a fully-protracted position, and a concave, hemitoroidal portion tangentially distal thereto; and follower means mounted in said guide for cooperating with said piston to exert an axial force against retractive displacement of said piston when said rod is in a fully-retracted position and hold said rod in said position, and for releasing said holding force upon a retractive displacement of said rod with a predetermined axial force in the opposite direction.

18. The apparatus of claim 17, wherein said follower means further comprise:

at least two ball bearings retained in said guide in radial opposition to said rod, said guide containing at least two radially-extending apertures therethrough evenly-spaced about its circumference for axial retention and radial movement of said balls therein, said balls being positioned axially from said closed end of said tube for about the distance between said proximate end and said hemitoroidial portion of said piston, for clamping said piston therebetween when said rod is about fully-protracted from said guide; and a sleeve spring snapped about the circumference of said guide at said axial position of said balls for retaining said balls therein and for biasing said balls radially inward.

19. The apparatus of claim 17, wherein said follower means further comprise:

a U-shaped spring clip snapped about the circumference of said guide, said guide having a pair of radially-opposed transverse slots therethrough to receive and retain said clip such that a portion of said clip extends through each said slot and transversely through said guide to cooperate with said spherically-shaped end and hemitoroidial portion of said piston to exert an axial force against retractive displacement of said piston when said rod is in a fully-protracted position, to hold said rod in said position, and for releasing said holding force upon a retractive displacement of said rod with a predetermined force.

20. A doorstop and holdopen for a door hingably-attached to a door frame, comprising:

a tubular guide having means at one end for attaching said guide for pivotal movement to one of said door or said frame, said means for attaching the tubular guide to the door or door frame including an extension spring, which is adapted to only extend or be activated when a force is applied to the door when the elongated member is fully protracted, whereby the spring absorbs the force, and a closed second end containing an aperture therethrough;

an elongated member having a first end and a second end, said first end having means thereat for attaching said member for pivotal movement to the other of said door or said frame, said member extending through said aperture into said guide and having an enlarged portion at said second end slidably-retained therein for aligning said member axially during protractive and retractive sliding movement relative to said guide and for stopping said member against further protractive movement when said portion is in abutment with said closed end of said guide, said enlarged portion having camming means thereon for exerting radial forces with axial movement of said member; and follower means mounted in said second end of said guide for cooperating with said camming means on said enlarged portion of said member to exert an axial force against retractive displacement of said member when said member is in a fullyprotracted position and hold said member in said position, and for releasing said force upon a protractive displacement of said member with a predetermined axial force in the opposite direction.

21. A combination holdopen and doorstop apparatus for use with a door hinged about a vertical axis comprising:

a rod guide adapted to be connected hingedly to either the door or a door frame, having an aperture in the unattached end for slidably receiving a rod, a rod which extends through the aperture in the guide and is hingedly attached to the other of the door or door frame, camming surfaces on the rod which coact with cam followers on the guide to releasably hold the door in a first open position, a stop member on the rod located within the guide which prevents the rod from further extension through the guide aperture when the door reaches a second greater open position; and an extension spring connecting the rod guide to the door or door frame, and said extension spring being only extended or activated when a force is applied to the door when it is in its second open position. thereby serving a shock absorber function.

* * * * *